US008465148B2

(12) United States Patent
Bauer et al.

(10) Patent No.: US 8,465,148 B2
(45) Date of Patent: Jun. 18, 2013

(54) DUPLEX WEB PRINTER WITH TURNING MECHANISM

(75) Inventors: Eckhard Bauer, Kiel (DE); Domingo Rohde, Kiel (DE); Thomas Koester, Oldenburg (DE); Randy Eugene Armbruster, Rochester, NY (US); Christopher M. Muir, Rochester, NY (US); Bradley Charles DeCook, Rochester, NY (US); Nathan J Turner, Rochester, NY (US); William F. Dassero, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/218,736

(22) Filed: Aug. 26, 2011

(65) Prior Publication Data

US 2012/0062673 A1 Mar. 15, 2012

Related U.S. Application Data

(63) Continuation of application No. PCT/EP2009/052344, filed on Feb. 27, 2009, which is a continuation of application No. PCT/EP2009/054990, filed on Apr. 24, 2009.

(51) Int. Cl.

| | |
|---|---|
| ***B41J 2/01*** | (2006.01) |
| ***B41J 29/38*** | (2006.01) |
| ***B65H 3/14*** | (2006.01) |

(52) U.S. Cl.
USPC ..... 347/104; 271/97; 347/16

(58) Field of Classification Search
None
See application file for complete search history.

(56) References Cited

U.S. PATENT DOCUMENTS

| | | | | |
|---|---|---|---|---|
| 3,309,037 | A | 3/1967 | Amos | |
| 4,453,841 | A * | 6/1984 | Bobick et al. | 347/16 |
| 4,475,128 | A * | 10/1984 | Koumura | 358/296 |
| 5,315,461 | A * | 5/1994 | Todd | 360/90 |

FOREIGN PATENT DOCUMENTS

| | | |
|---|---|---|
| DE | 40 11 405 A1 | 4/1990 |
| JP | 58-059148 | 4/1983 |
| JP | 62-215455 | 3/1986 |

* cited by examiner

*Primary Examiner* — Stephen Meier
*Assistant Examiner* — Alexander C Witkowski
(74) *Attorney, Agent, or Firm* — Kevin E. Spaulding

(57) ABSTRACT

A printing machine for printing on a web includes a plurality of guide rollers for guiding the web through a simplex and a duplex path in the printing machine. The duplex path is adjacent and laterally shifted with respect to the simplex path. An apparatus for turning or laterally shifting the web and transfer the web from the simplex path to the duplex path includes four rollers. 90° twists are present between rollers 1 and 2 and between rollers 3 and 4. Rollers 1 and 4 are substantially parallel, and rollers 2 and 3 are substantially parallel. Rollers 1 and 4 are substantially at right angles to rollers 2 and 3.

16 Claims, 6 Drawing Sheets

DUPLEX WEB PRINTER WITH TURNING MECHANISM

CROSS-REFERENCE TO RELATED APPLICATIONS

This application is a continuation of prior WO Patent Application No. PCT/EP2009/052344, filed Feb. 27, 2009 and WO Patent Application No. PCT/EP2009/054990, filed Apr. 24, 2009, each of which is incorporated herein by reference in its entirety.

This application is co-filed with and has related subject matter to U.S. Patent Application Publication No. US20120067239 Mar. 22, 2012.

TECHNICAL FIELD

The present invention relates to turning or laterally shifting a web in a printing machine.

BACKGROUND ART

In the printing industry, it is known to print on a continuous web while it is transported through a one-directional print engine. Such a one-directional print engine, for example, provides a print medium, such as ink or toner, on one side of the continuous web, typically the top side, while it is transported along the print engine. Such a print engine can comprise a single print head for a single color print or a plurality of print heads for multicolor prints. For multicolor prints typically at least four print heads are provided using the colors cyan, magenta, yellow and carbon (black).

If double-sided printing on the continuous web is desired by such a one-directional print engine, it is necessary to turn or flip the web by 180° to permit a second pass of the web through the one-directional print engine, in such a state that the previously non-printed side of the web faces the respective print head(s) of the print engine.

To perform this turning function, it has been known to utilize a so-called "turn-bar arrangement", which is typically made up of several stationary turn bars, which are angled with respect to a paper transport path to provide a turning function. Inasmuch as the turn bars are typically stationary, contact between the web and the turn bar should preferably be reduced to a minimum, in order to avoid vibration of the turn bar or the web. Therefore, such turn bars are typically provided with through holes, to permit air to be blown through the turn bar, in order to generate an air cushion between the turn bar and a web while it is traveling around the turn bar.

Despite the fact that such an arrangement permits both a turning and a lateral shifting of the web, such system is rather expensive and causes a lot of noise due to the blowing of air through the turn bar. Furthermore, the air cushion between the turn bar and the web is not always stable, thus, causing problems in appropriately guiding the web through the print engine.

An alternative turning device for a continuous web is for example known from IBM Technical Disclosure Bulletin, Vol. 22, No. 6, Nov. 19, 1979 page 2465. In this turning device a continuous web is guided after having been printed on a first side around a first roller, a second roller oriented at 90° with respect to the first roller and a third roller arranged at an angle of 90° to the second roller, i.e. parallel to the first roller. The web is guided around these rollers in such a manner that between the first and second roller and the second and third roller the web performs a 90° twist. The second roller is arranged approximately at a midpoint between the first and second rollers, such that turning and laterally shifting of the web is achieved. This arrangement, however, causes problems with properly guiding the web, inasmuch as the second roller will cause a tendency of the web to move towards the diverting line between the second and third rollers. There is, therefore, a continuing need for ways of turning a web.

SUMMARY OF THE INVENTION

According to an aspect of the present invention, there is provided a printing machine for printing on a web, comprising:

a plurality of guide rollers for guiding the web through the printing machine, the plurality of rollers being arranged to define a simplex path and a duplex path for the web, the duplex path being arranged adjacent and laterally shifted with respect to the simplex path;

at least one print arrangement positioned for printing an image on the web while the web is moved along the simplex path and the duplex path; and an apparatus for turning or laterally shifting the web, the apparatus being arranged to transfer the web from the simplex path to the duplex path and including:

- a first roller for guiding the web, the first roller having a first axis of rotation;
- a second roller for guiding the web, the second roller having a second axis of rotation;
- a third roller for guiding the web, the third roller having a third axis of rotation; and
- a fourth roller for guiding the web, the fourth roller having a fourth axis of rotation;
- wherein the first, second, third, and fourth rollers are arranged to permit guiding the web around the rollers in that order, the first and second rollers are spaced a distance which permits the web to perform a 90° twist in the strand extending between these rollers, the third and fourth rollers are spaced a distance which permits the web to perform a 90° twist in the strand extending between these rollers, the first and fourth axis of rotation are substantially parallel to each other, the second and third axis of rotation are substantially parallel to each other, and the first and fourth axis of rotation are substantially at right angles to the second and third axis of rotation, so that the web is turned by 180°.

According to another aspect of the present invention, there is provided an apparatus for turning a web in a printing machine, the apparatus comprising:

a first roller for guiding the web, the first roller having a first axis of rotation;

a second roller for guiding the web, the second roller having a second axis of rotation;

a third roller for guiding the web, the third roller having a third axis of rotation; and a fourth roller for guiding the web, the fourth roller having a fourth axis of rotation;

wherein the first, second, third, and fourth rollers are arranged to permit guiding the web around the rollers in that order, wherein the first and second rollers are spaced a distance which permits the web to perform a 90° twist in the strand extending between these rollers, the third and fourth rollers are spaced a distance which permits the web to perform a 90° twist in the strand extending between these rollers, the first and fourth axis of rotation are substantially parallel to each other, the second and third axis of rotation are substantially parallel to each other, and the first and fourth axis of rotation are substantially at right angles to the second and third axis of rotation.

This invention advantageously permits both turning and laterally shifting of a web in a printing machine, while permitting good guidance of the web. Various embodiments permit printing on both sides of a continuous web, if the web is both turned and laterally shifted between the simplex and duplex paths, or twice printing on the same side of the web, if the web is only laterally shifted between the simplex and duplex paths but not turned.

In various embodiments, the first twist is arranged such that the side of the web contacting the first roller also contacts the second roller, so an image on the first side of the web is advantageously be kept out of contact with the rollers for an extended period of time. In various embodiments, the first twist and the second twist are oriented in the same way, so that the web advantageously performs a 180° twist while being guided around the rollers, i.e. the web is turned or flipped over. Alternatively, the first and second twists can be oriented in opposite ways such that the web does not perform a twist, i.e. it keeps its original orientation. This can for example be advantageous, if the same side of the web is to be printed on twice. Lateral shifting can be performed independently of rotation The foregoing and other objects, features and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
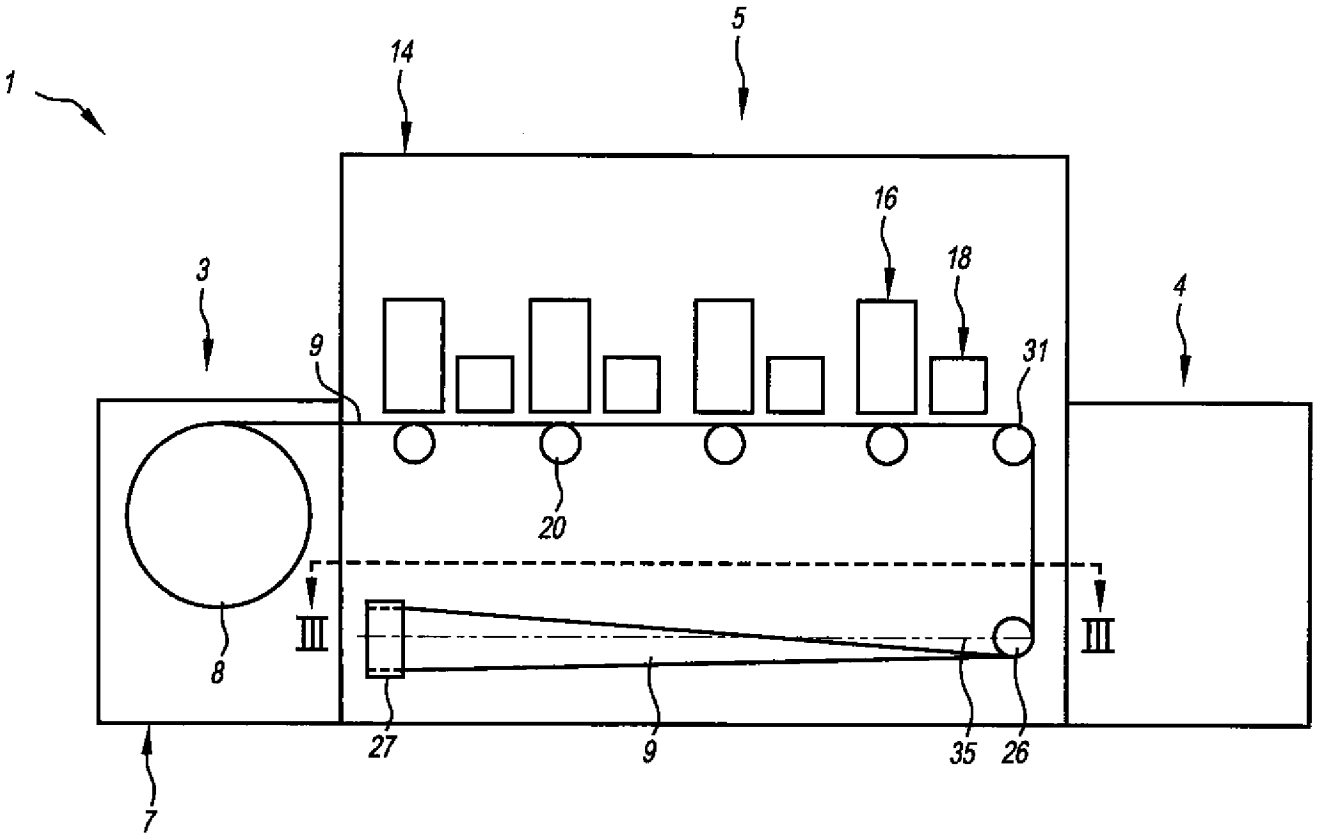
FIG. 1 is a schematic side view of a web printing apparatus along line I-I in FIG. 3.

In the following description relative terms such as left, right, above and below and others can be used. These terms are used for illustrative purposes only and relate to the embodiments shown in the drawings. The relative terms are not to be construed to limit the application.

In various embodiments, a turning apparatus comprises a first roller for guiding the web, the first roller having a first axis of rotation, a second roller for guiding the web, the second roller having a second axis of rotation, a third roller for guiding the web, the third roller having a third axis of rotation and a fourth roller for guiding the web, the fourth roller having a fourth axis of rotation. The first to fourth rollers are arranged to permit guiding of the web around the rollers in that order, wherein the first and second rollers are spaced a distance, which permits the web to perform a 90° twist in a strand extending between these rollers. The third and fourth rollers are also spaced a distance, which permits the web to perform a 90° twist in the strand extending between these rollers. The first and fourth axis of rotation are substantially parallel to each other, the second and third axis of rotation are substantially parallel to each other, and the first and fourth axis of rotation are substantially at right angles to the second and third axis of rotation. This arrangement permits a web to be twisted by 90° between the first and second rollers, to be laterally shifted between the second and third rollers and to be again twisted by another 90° between the third and fourth rollers. Thus, the lateral shifting is decoupled from the turning of the web, thereby improving guidance of the web through the apparatus.

In various embodiments, the first and second rollers are arranged such that a plane which extends at right angles to the axis of rotation of one roller and bisects a respective web guide surface of the roller extends through the other roller. Thus, the rollers are approximately centered with respect to each other, thus permitting the web to be guided in a stable manner on each of the rollers. Preferably, the above defined plane extends through the axis of rotation of the other rollers, thus providing an exact centering of the rollers with respect to each other. A similar relationship can be provided between the third and fourth rollers.

The second and third rollers can be arranged such that a plane which extends at right angles to the axis of rotation of one roller and which bisects a respective web guide surface of the roller is substantially coplanar to a respective plane of the other roller. Thus, the second and third rollers are also centered with respect to each other to improve guidance of the web there around. The second and third rollers can be spaced in a lateral shift direction only, i.e. while extending between the second and third rollers, the web is moved substantially only in a lateral shift direction. Alternatively, the second and third rollers can be spaced both in a lateral shift direction and a second direction.

In various embodiments, the first and fourth rollers are arranged substantially horizontal and the second and third rollers are arranged substantially vertical, which allows the web to be guided in a horizontal manner prior and after turning or laterally shifting thereof, as is typically advantageous for printing purposes. Preferably, the second and third rollers are crown rollers, i.e. rollers having a curved form in a direction transverse to a running direction, in particular a circular curved form having a center located on a plane bisecting the web guide surface direction. Such crown rollers provide a self-centering function with respect to the web, which is especially advantageous when the rollers are vertically arranged.

The apparatus can comprise a web position sensor for detecting the position of the web on the first or fourth roller. A device for moving at least one of the second and third rollers in the direction of the axis of rotation of the first or fourth rollers responsive to an output of the web position sensor can be provided. Such a device can be used as an integrated web guide within the apparatus.

In various embodiments, a printing machine for printing on a web includes a plurality of rollers for guiding the web through the printing machine, the plurality of rollers being arranged to define a simplex path and a duplex path for the web, the duplex path being arranged adjacent and laterally shifted with respect to the simplex path. At least one print arrangement can be positioned for printing an image on the web while being moved along the simplex path and the duplex path. The printing machine also comprises an apparatus for turning or laterally shifting the web as described herein, the apparatus being arranged to transfer the web from the simplex path to the duplex path.

The at least one print arrangement can comprise at least one inkjet print head, which can print on the web both in the simplex as well as the duplex path. The at least one print arrangement can also comprise separate inkjet print heads for printing on the web in the simplex path and the duplex path. To provide multi color printing, preferably at least four print arrangements are provided.

In various embodiments, a method for turning or laterally shifting a web in a printing machine is provided. The method comprising the steps of guiding the web around a first roller, guiding the web around a second roller, the second roller being rotated with respect to the first roller by about 90°, such that a strand of the web extending between the first and second rollers performs a first twist by about 90°, guiding the web around a third roller arranged about parallel to the first roller such that the strand of the web extending between the second and third rollers is straight, and guiding the web around a fourth roller, the fourth roller being rotated with respect to the third roller by about 90° such that the strand of the web extending between the third and fourth rollers performs a second twist by about 90°.

FIGS. 1 to 3 and 5 show a first embodiment of a printing machine 1. The printing machine 1 has a web feeding section 3, a web receiving section 4 and a printing section 5 arranged between the web feeding section 3 and the web receiving section 4.

The web feeding section has a frame 7, in which a roller 8 for a web 9 is received. The roller 8 is rotatively supported within the frame 7, such that the web 9 can be unwound from the roller 8 in a known manner.

Figure 2:
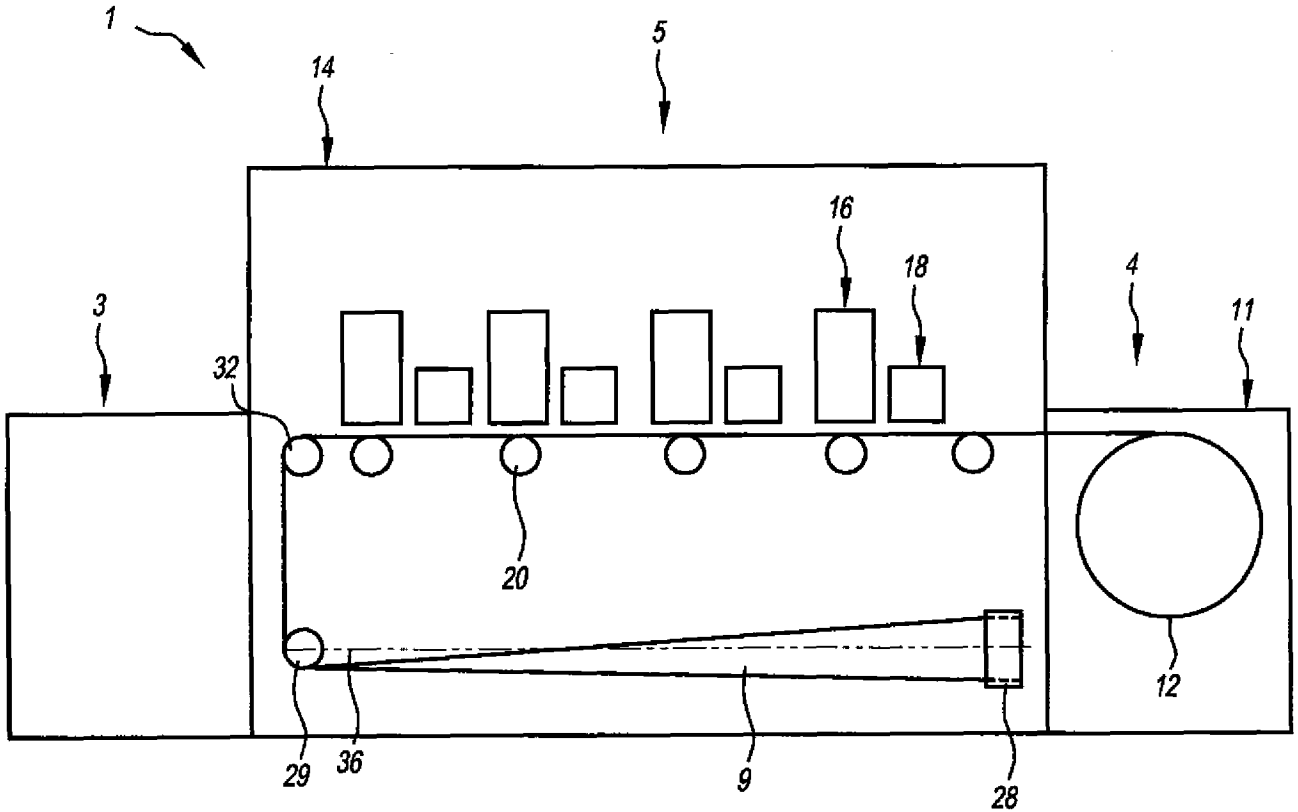
FIG. 2 is a schematic side view along line II-II in FIG. 3.
Figure 3:
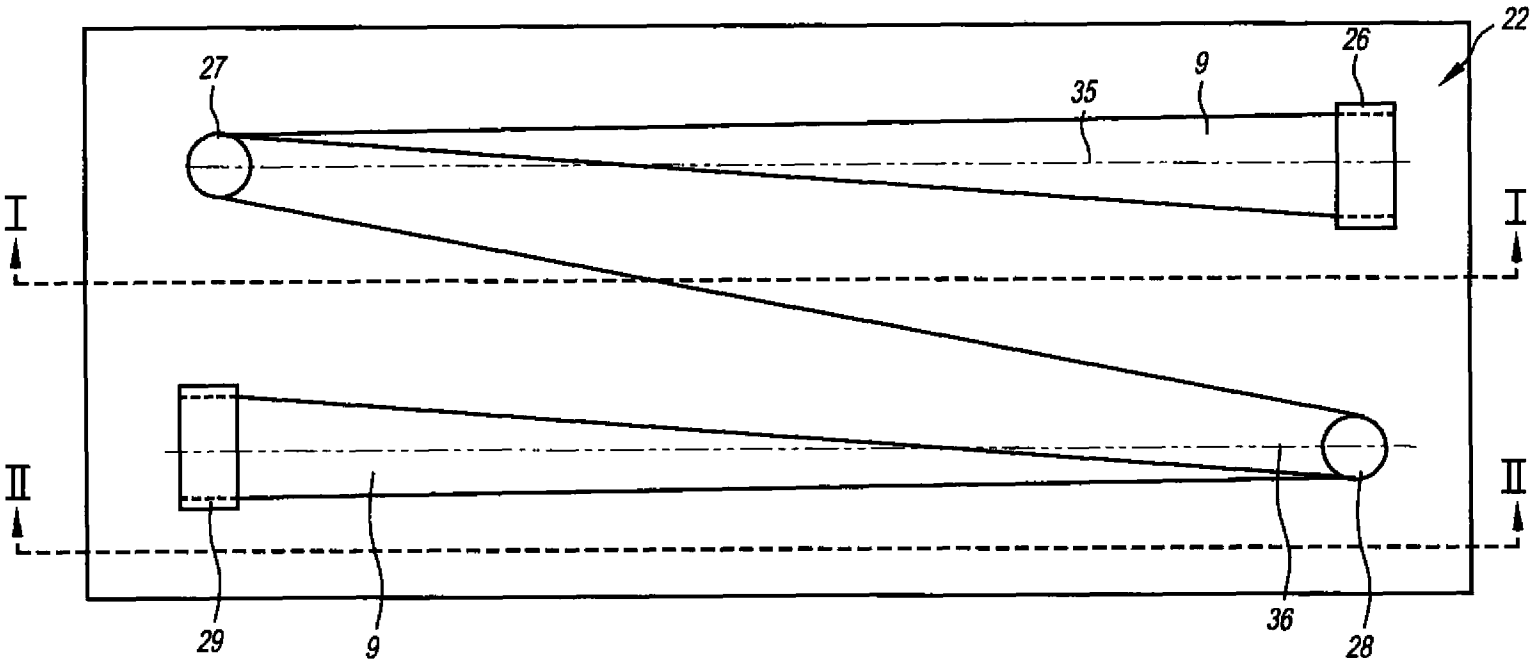
FIG. 3 is a schematic top view onto a turning or laterally shifting device for a web in a printing machine, along line in FIG. 1.

The web receiving section, which is best shown in FIG. 2, has a frame 11 rotatively supporting a roller 12 for receiving the web 9 after it has been guided through the printing section 5. The web feeding section 3 and the web receiving section 4 have been shown in a very simplified manner, and a plurality of rollers can be provided in each section for providing web guidance or web tensioning mechanisms, as is known in the art.

The printing section 5 comprises a frame 14, supporting a plurality of print engines 16, a plurality of dryers 18, a plurality of rollers 20 for guiding the web 9 along the print engines 16 and a roller arrangement 22 for turning or laterally shifting the web 9 in the printing machine 1.

Figure 5:
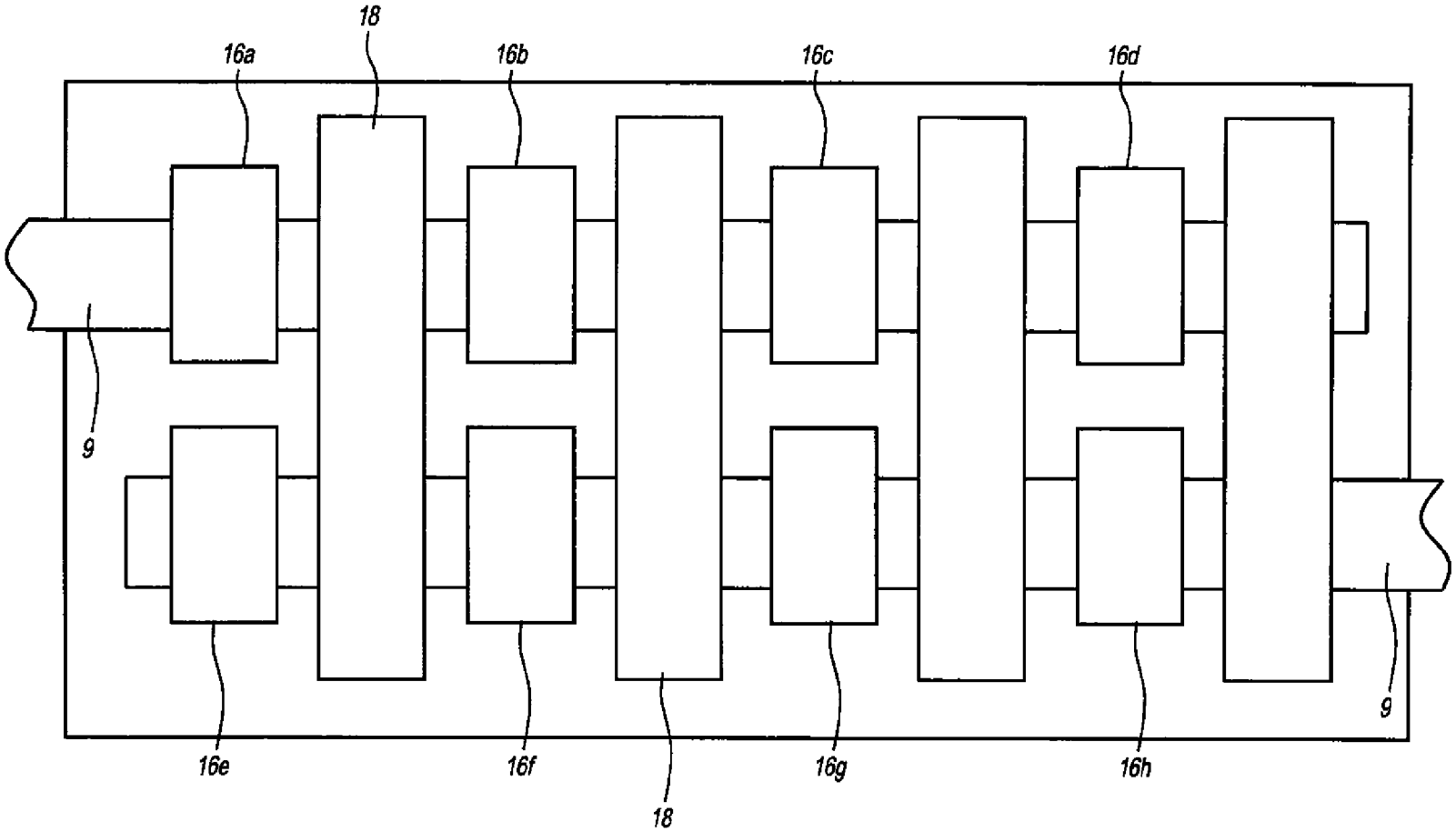
FIG. 5 is a top view onto a printing apparatus of FIG. 3.

As can be seen in FIG. 5, two tiers of print engines 16 are provided adjacent each other. The first tier of print engines 16 consist of print engines 16*a* to d and the second tier of print engines 16 consist of print engines 16*e* to 16*h*. The print engines 16*a* to 16*d* are arranged to cover a first path of the web 9 through the printing machine 1. The path of the web extending below print engines 16*a* to 1*d*D will be called a simplex path in the following. Print engines 16*e* to 16*h* are arranged to cover a second path of the web 9 through the printing machine 1. This second path will be called a duplex path in the following.

The print engines 16 are for example of the inkjet type. The print engines 16*a* to 16*d*, covering the simplex path, can use different colors, such as cyan, magenta, yellow and carbon (black) for multicolor prints. Similarly, print engines 16*e* to 16*h*, covering the duplex path, can use the same colors as print engines 16*a* to 16*d*, if multicolored printing on both sides of the web 9 is desired. Alternatively, print engines 16*e* to 16*h* can use different colors, if for example additional colors are to be printed on the same or reverse side of the web, as will be explained in more detail herein below.

Even though, adjacent print engines 16*a* and 16*e* in the simplex and the duplex path are shown as separate print engines, they can be formed by a single print engine, which covers both the simplex path and the duplex path.

Between the print engines 16*a* to 16*d* in the simplex path and 16*e* to 16*h* in the duplex path, dryers 18 are provided, which cover both the simplex and the duplex path. The dryers 18 can be formed by any suitable type of dryer for drying ink on the web 9. Even though, the dryers 18 are shown as intra-station dryers, i.e. being arranged between print engines 16, a single dryer at the end of the simplex path and at the end of the duplex path can also be provided.

If the print engines 16 are for example of the electrophotographic type, the dryers 18 could be replaced by respective fuser arrangements, which would typically by provided at the end of the simplex path and at the end of the duplex path.

As mentioned above, rollers 20 are provided for guiding the web 9 in the vicinity of the print engines 16.

Further to these rollers 20, a roller arrangement 22 for turning or laterally shifting the web 9 is provided. The roller arrangement 22 is arranged to guide the web 9 from the simplex path to the duplex path, thereby providing a lateral shift of the web 9.

The roller arrangement 22 has of a first roller 26, a second roller 27, a third roller 28 and a fourth roller 29. Additionally a roller 31 is arranged at the end of the duplex path, to permit the web 9 to be guided towards first roller 26 (see FIG. 1). Similarly, a roller 32 is provided at the beginning of the duplex path, to permit the web 9 to be guided from the fourth roller 29 towards the duplex path.

The first and second rollers 26, 27 are arranged below the duplex path and the third and fourth rollers 28, 29 are arranged below the duplex path.

The first roller 26 has an axis of rotation, which is substantially parallel to the axis of rotation of each of the rollers 20, 31, 32 and the fourth roller 29.

The second and third rollers 27, 28 each have an axis of rotation which is substantially at right angles to the axis of rotation of the other rollers, in particular the first and fourth rollers 6, 29. The first and second rollers 26, 27 are arranged such that a plane (indicated at 35 in FIGS. 1 and 3) which extends at right angles to the axis of rotation of one of the rollers 26, 27 and bisects a respective web guide surface thereof extends through the other roller 27, 26, and in particular through the axis of rotation of the other roller 27, 26. Thus, the respective rollers are centered with respect to each other but rotated by 90° to each other. The third and fourth rollers 28, 29 are similarly arranged, as indicated at 36 in FIGS. 3 and 2. Thus, also the third and fourth rollers 28, 29 are centered with respect to each other but rotated by 90° to each other.

The first and second rollers are spaced a distance, which permits the web to perform a 90° twist in the strand extending between these rollers. Similarly, the third and forth rollers 28, 29 are also spaced a distance which permits the web to perform a 90° twist in the strand extending between these rollers. The 90° twist being provided due to the fact that the rollers are rotated 90° with respect to each other. Due to the fact that the rollers are centered with respect to each other, as explained above, no side forces act on the web, while being guided by rollers 26 and 27. If the rollers are not centered, side forces can act on the web, which can cause damage of the web or which can lead to the fact that the web moves sideways off the respective rollers 26, 27. The same is true for the third and fourth rollers 28, 29. The second and third rollers 27, 28 are spaced in a lateral direction, to provide a lateral shift of the web 9, in order to transfer the web 9 from the simplex path to the duplex path. Due to the fact that the axis of rotation of each of the second and third rollers 27, 28 is substantially parallel, the web 9 extends straight between these two rollers 27, 28.

The 90° twist in the web 9 between the first and second rollers 26, 27 can be in the same direction as the 90° twist between the third and fourth rollers 28, 29. In this case, the web is not only laterally shifted, but also turned upside down or flipped. This enables double-sided printing on the web.

The first 90° twist between the first and second rollers 26, 27, however, can also be in a different direction to the second 90° twist between the third and fourth rollers 28, 29. In this case, the web will not be turned upside down, but only laterally shifted. This would enable additional printing on the same side the web, while it is in the duplex path. In this case, additional colors can be provided in the print engines 16*e* to 16*h*. Such additional colors can for example be gold, silver or other special colors which may not be producible by the colors used in print engines 16*a* to 16*d*.

Figure 6:
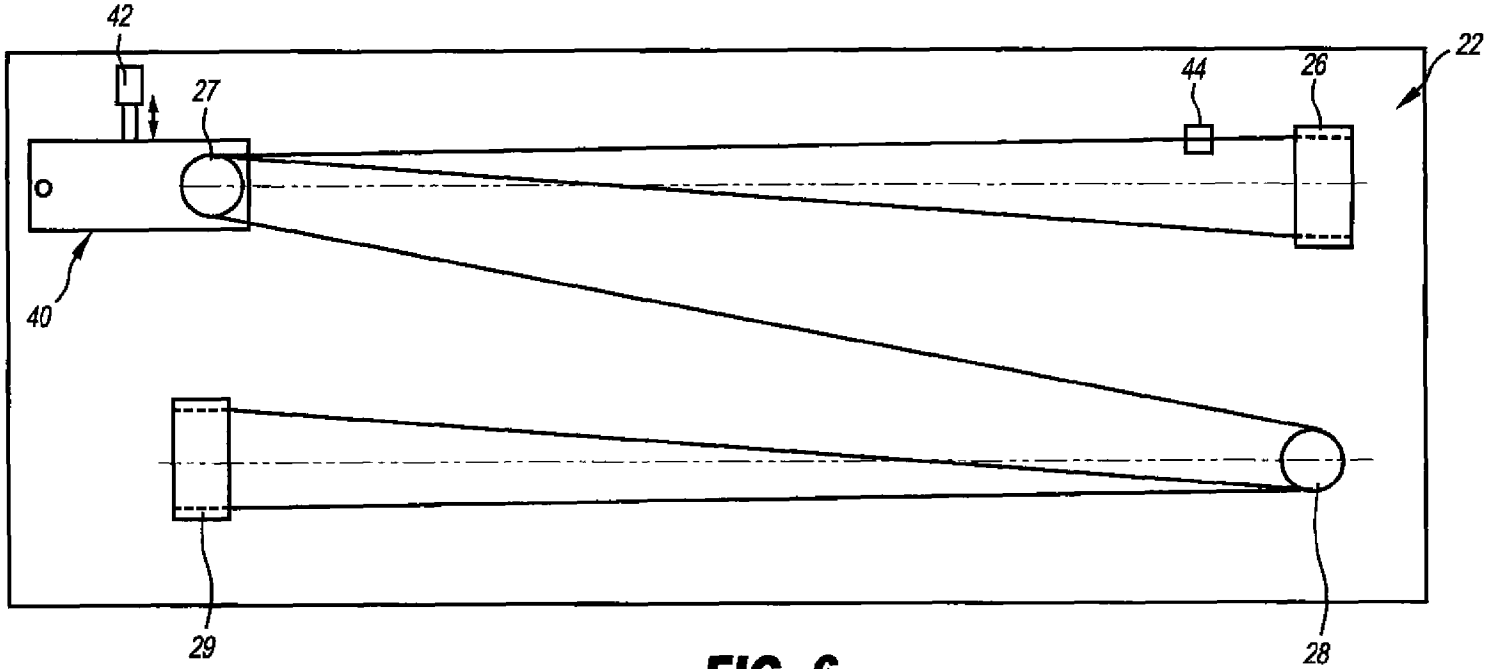
FIG. 6 is a schematic top view similar to FIG. 3 onto an alternative apparatus for turning or laterally shifting a web in a printing machine.

FIG. 6 shows an alternative embodiment of the roller arrangement 22, in which the same reference signs will be used as in the previous description. The roller arrangement 22 again consists of a first roller 26, a second roller 27, a third roller 28 and a fourth roller 29. The rollers are arranged in the same manner as previously discussed.

The second roller, however, is mounted on one end of the bracket 40, which is pivotably mounted at its other end. A guide motor 42 is provided, which permits the bracket to be moved around its pivotable end, as indicated by the double headed arrow. In so doing, the second roller 27 is moved sideways with respect to the first roller 26. The skilled person will realize that this movement also has a component directed towards and away from the first roller, but this component is of lesser importance. The sideways movement of the second roller 27 can be used as a web guide to properly guide the web 9 on the first roller 26. To achieve this purpose, a position sensor 44, such as an edge sensor, can be provided in the vicinity of the first roller 26. An edge sensor can sense the edge of the web 9 and thereby the position of the web 9 on the first roller 26. The guide motor 42 can be moved in response to an output signal of the edge sensor, in order to appropriately position the web 9 on the first roller 26.

Figure 4:
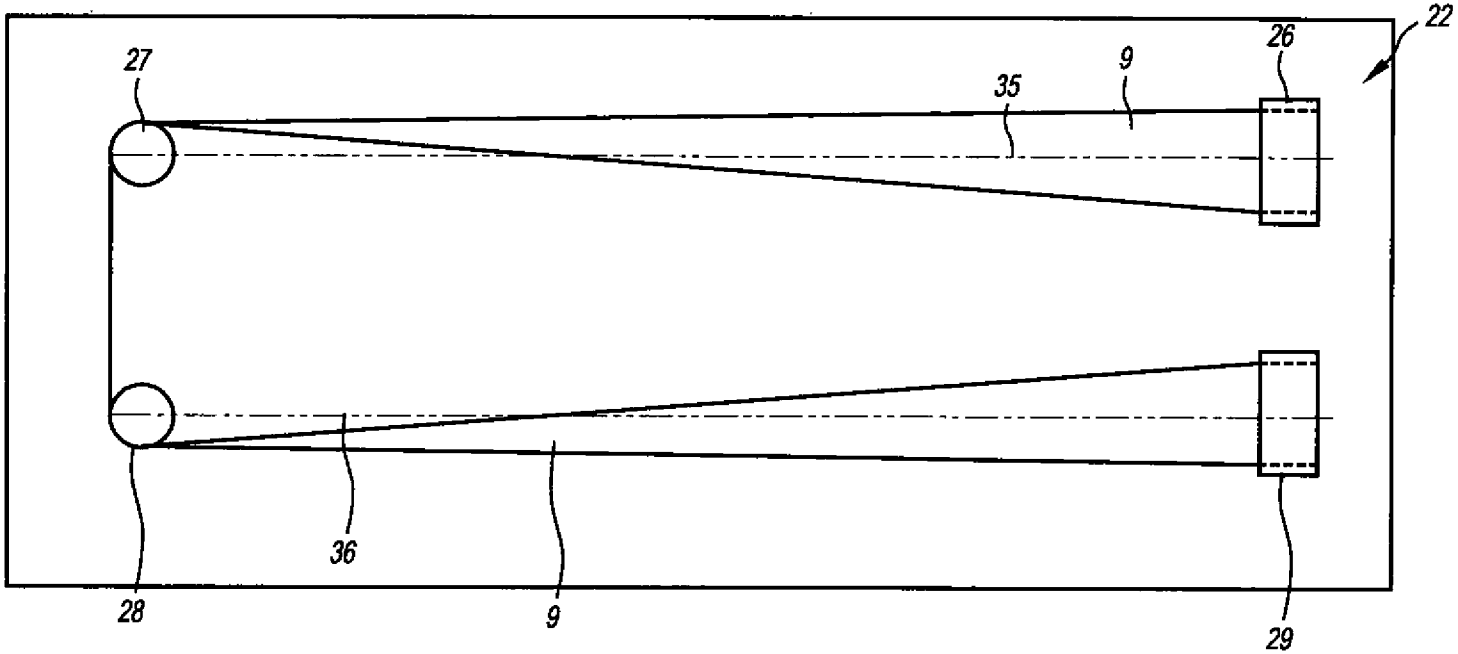
FIG. 4 is a schematic top view similar to FIG. 3 onto an apparatus for turning or laterally shifting a web in a printing machine according to an alternative embodiment.

A similar arrangement can be provided for the third roller 28 and an edge sensor can be provided in a vicinity of the fourth roller 29. FIG. 4 shows an alternative roller arrangement 22 for turning or laterally shifting the web 9.

In FIG. 4 again the same reference signs will be used as in the previous description. The roller arrangement 22 again has a first roller 26, a second roller 27, a third roller 28 and a fourth roller 29. The axis of rotation of the first and fourth rollers 26, 29 are substantially parallel to each other. Similarly, the axis of rotation of the second and third rollers 27, 28 are substantially parallel to each other and are rotated by 90° with respect to the axis of rotation of the first and fourth rollers 28, 29. The first and second rollers 26, 27 are again centered with respect of each other and sufficiently spaced to permit the web 9 to perform a 90° twist in the strand extending therebetween.

Also the third and fourth rollers 28, 29 are again centered with respect to each other as explained above and are spaced sufficiently to permit the web to perform a 90° twist in the strand extending between.

The arrangement of FIG. 4 differs from the previous arrangement inasmuch as the second and third rollers 27, 28 are adjacent each other in the lateral shift direction. Similarly, the first and fourth rollers 26, 29 are adjacent to each other in the lateral shift direction. When this arrangement is used, the simplex and duplex path of the printing machine can run in opposite directions, such that the web feeding section and the web receiving section can be arranged on the same side of the printing machine 1.

Figure 7:
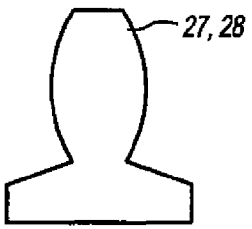
FIG. 7 is a schematic side view of a roller to be used in the apparatus for turning or laterally shifting a web in a printing machine.

FIG. 7 shows a side view of a specific embodiment of the second and fourth roller 27 and 28. As indicated, in the above embodiment the second and third rollers 27, 28 are arranged vertically and therefore the web can have a tendency to move down by gravity. The rollers 27, 28 are, however, in this embodiment formed as crown rollers, i.e. rollers having a curved form in a direction transverse to a running direction. In particular, a circular curved form having a center located on a plane bisecting the web guide surface in transverse direction is provided. Such crown rollers provide a self centering function of the web while the web is moved there around either during printing or webbing operation.

Next a method of printing on a web will be described under reference of the drawings.

First, the web has to be introduced into the printing machine and it is typically manually guided to extend along the print engines covering the simplex path. Then it is guided around roller 31 to extend to roller 26. Next it is guided around roller 26 and to roller 27. The web 9 is guided in such a manner that it performs a 90° twist in the strand extending between the first and second rollers 26, 27. The web 9 can be guided in such a manner, that the top side thereof, i.e. the side which is on top in the simplex path, will not contact the second roller 27. The web 9 is then guided towards and around the third roller 28. From the third roller 28 the web 9 is guided to the fourth roller 29, and again a 90° twist is introduced into the web 9. This 90° twist can be in the same or in an opposite direction to the first twist, as indicated above. From roller 29 the web 9 is guided towards roller 32 and through the duplex path towards the web receiving section. Once the web is guided in this manner through the printing machine 1 and it extends between the web feeding and the web receiving section, printing on the web can start in a known manner.

The invention has been described with respect to specific embodiments thereof without being limited to these specific embodiments.

The invention claimed is:

1. A printing machine for printing on a web, comprising:

a plurality of guide rollers for guiding the web through the printing machine, the plurality of rollers being arranged to define a simplex path and a duplex path for the web, the duplex path being arranged adjacent and parallel to the simplex path and being laterally shifted in a lateral shift direction with respect to the simplex path;

at least one print engine positioned for printing an image on the web while the web is moved along the simplex path and the duplex path; and an apparatus for laterally shifting the web, the apparatus being arranged to transfer the web from the simplex path to the duplex path and including:

a first roller for guiding the web, the first roller having a first axis of rotation;

a second roller for guiding the web, the second roller having a second axis of rotation;

a third roller for guiding the web, the third roller having a third axis of rotation; and a fourth roller for guiding the web, the fourth roller having a fourth axis of rotation;

wherein the first, second, third, and fourth rollers are arranged to permit guiding the web around the rollers in that order, the first and second rollers are spaced a distance which permits the web to perform a 90° twist in the strand extending between these rollers, the second and third rollers are spaced apart in the lateral shift direction, the third and fourth rollers are spaced a distance which permits the web to perform a 90° twist in the strand extending between these rollers, the first and fourth axis of rotation are substantially parallel to each other, the second and third axis of rotation are substantially parallel to each other, and the first and fourth axis of rotation are substantially at right angles to the second and third axis of rotation, wherein the web is laterally shifted in the lateral shift direction by passing around the first, second, third, and fourth rollers.

2. The printing machine according to claim 1, wherein the at least one print engine comprises at least one ink jet print head.

3. The printing machine according to claim 2, wherein the at least one print engine comprises separate ink jet print heads for printing on the web in the simplex path and the duplex path.

4. The printing machine according to claim 1, wherein the at least one print engine includes at least four print engines to provide multi-color printing.

5. The printing machine according to claim 1, wherein the apparatus for laterally shifting the web also turns the web so that the at least one print engine prints on an opposite side of the web in the duplex path relative to the simplex path.

6. An apparatus for turning a web in a printing machine, the apparatus comprising:

a first roller for guiding the web, the first roller having a first axis of rotation;

a second roller for guiding the web, the second roller having a second axis of rotation;

a third roller for guiding the web, the third roller having a third axis of rotation; and a fourth roller for guiding the web, the fourth roller having a fourth axis of rotation;

wherein the first, second, third, and fourth rollers are arranged to permit guiding the web around the rollers in that order, the first and second rollers are spaced a distance which permits the web to perform a 90° twist in the strand extending between these rollers, the second and third rollers are spaced apart in a lateral shift direction, the third and fourth rollers are spaced a distance which permits the web to perform a 90° twist in the strand extending between these rollers, the first and fourth axis of rotation are substantially parallel to each other, the second and third axis of rotation are substantially parallel to each other, and the first and fourth axis of rotation are substantially at right angles to the second and third axis of rotation, so that the web is turned by 180° and laterally shifted in the lateral shift direction by passing around the first, second, third, and fourth rollers.

7. The apparatus according to claim 6, wherein the first and second rollers are arranged so that a plane that extends at right angles to the axis of rotation of one of the first and second rollers and bisects a respective web guide surface of the one of the first and second rollers extends through the other of the first and second rollers.

8. The apparatus according to claim 7, wherein the first and second rollers are arranged so that the plane that extends at right angles to the axis of rotation of one of the first and second rollers and bisects the respective web guide surface of the one of the first and second rollers extends through the axis of rotation of the other of the first and second rollers.

9. The apparatus according to claim 6, wherein the third and fourth rollers are arranged so that a plane that extends at right angles to the axis of rotation of one of the third and fourth rollers and bisects a respective web guide surface of the one of the third and fourth rollers extends through the other of the third and fourth rollers.

10. The apparatus according to claim 9, wherein the third and fourth rollers are arranged so that a plane that extends at right angles to the axis of rotation of one of the third and fourth rollers and bisects the respective web guide surface of the one of the third and fourth rollers extends through the axis of rotation of the other of the third and fourth rollers.

11. The apparatus according to claim 6, wherein the second and third rollers are arranged so that a plane that extends at right angles to the axis of rotation of one of the second and third rollers and bisects a respective web guide surface of the one of the second and third rollers is substantially coplanar to a respective plane of the other of the second and third rollers.

12. The apparatus according to claim 6, wherein the second and third rollers are further spaced apart in a second direction.

13. The apparatus according to claim 6, wherein the first and fourth rollers are arranged substantially horizontal and the second and third rollers are arranged substantially vertical.

14. The apparatus according to claim 6, wherein the second and third rollers are crown rollers.

15. The apparatus according to claim 6, further including a web position sensor for detecting the position of the web on the first or fourth roller.

16. The apparatus according to claim 15, further including a device for moving at least one of the second and third rollers in the direction of the axis of rotation of the first or fourth roller in response to an output of the web position sensor.

* * * * *